US006750415B2

(12) United States Patent
Yamagami

(10) Patent No.: US 6,750,415 B2
(45) Date of Patent: Jun. 15, 2004

(54) INPUT DEVICE HAVING AN OUTPUT THAT VARIES ACCORDING TO A PRESSING FORCE

(75) Inventor: Toru Yamagami, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/292,859

(22) Filed: Nov. 12, 2002

(65) Prior Publication Data

US 2003/0090395 A1 May 15, 2003

(30) Foreign Application Priority Data

Nov. 13, 2001 (JP) ..... 2001-347314

(51) Int. Cl.[7] ..... H01H 13/70
(52) U.S. Cl. ..... 200/517; 200/341; 338/47
(58) Field of Search ..... 200/517, 511, 200/512, 513, 341, 313, 314; 338/47, 95, 99, 114

(56) References Cited

U.S. PATENT DOCUMENTS 3,969,600 A * 7/1976 Sims, Jr. ..... 200/516
4,987,275 A * 1/1991 Miller et al. ..... 200/5 A
5,652,395 A * 7/1997 Hirano et al. ..... 73/849
5,664,667 A * 9/1997 Kenmochi ..... 200/314
5,729,222 A * 3/1998 Iggulden et al. ..... 341/31
5,986,221 A * 11/1999 Stanley ..... 177/136
6,067,005 A * 5/2000 DeVolpi ..... 338/47
6,303,887 B1 * 10/2001 Ando ..... 200/512

FOREIGN PATENT DOCUMENTS

JP 4-52575 8/1992

* cited by examiner

*Primary Examiner*—Lincoln Donovan
*Assistant Examiner*—K. Lee
(74) *Attorney, Agent, or Firm*—Brinks Hofer Gilson & Lione

(57) ABSTRACT

An input device includes a keytop, an elastic member, a movable electrode and a fixed electrode. The movable electrode is coupled to the elastic member above the fixed electrode. The electrodes are enclosed within a recess. A resistance of one of the fixed or movable electrodes changes when the electrodes are in contact based on a pressure exerted on the keytop.

13 Claims, 3 Drawing Sheets

INPUT DEVICE HAVING AN OUTPUT THAT VARIES ACCORDING TO A PRESSING FORCE

BACKGROUND

1. Field of the Invention

The present invention relates to an input device, and, more particularly, to an input device that can be used with a computer or a video screen.

2. Description of the Related Art

An input device can control many systems, for example, an input device can control a menu selection or a character movement in a video game.

As shown in FIG. 3, an input device can include a keytop 2 that is vertically and movably adjacent to a top case 1. An elastic member 3, which is made of an elastic rubber, is disposed below the keytop 2. An end of the elastic member 3 has a dome-shape made of an electrically conductive rubber 4. The electrically conductive rubber 4 has a contact surface 4*a* that protrudes downward in an arc shape.

A sheet member 5 is disposed below the elastic member 3. A fixed-electrode 6, which is a resistive member, is supported on a portion of a surface of the sheet member 5 opposing the electrically conductive rubber 4. The sheet member 5 is mounted to a surface of a bottom case 7. The keytop 2 is elastically biased upward by a biasing force of the elastic member 3. A gap is formed between the fixed electrode 6 and the electrically conductive rubber 4.

A switching circuit is formed by the electrically conductive rubber 4 and the fixed electrode 6. Through contact between the electrically conductive rubber 4 and the fixed electrode 6, the switching circuit is turned on. When the keytop 2 shown in FIG. 3 is pressed downward, the electrically conductive rubber 4 at an end of the elastic member 3 moves downward towards the fixed electrode 6. This movement causes the electrically conductive rubber 4 to contact the fixed electrode 6, turning on the switching circuit. In addition, the pressing force on the keytop 2 elastically deforms the electrically conductive rubber 4 so that the contact area between the electrically conductive rubber 4 and the fixed electrode 6 changes.

By changing the contact area between the electrically conductive rubber 4 and the fixed electrode 6, the resistance of the fixed electrode 6 changes. This change in resistance can control a menu selection in a personal computer or a character movement in a television game.

It can be difficult manufacture input devices as those described above since the elastic member 3 and the electrically conductive rubber 4 are integrally formed by two molding processes that use a material kneaded with an electrically conductive material and an insulating material, such as rubber. The molding die can also be costly.

SUMMARY

An input device embodiment comprises a pressable keytop, an elastic member, a movable electrode, and a fixed electrode. Preferably, the movable electrode can come into electrical conductance with the fixed electrode by an elastic deformation of the elastic member. Preferably, the movable electrode is formed on a sheet member disposed above the fixed electrode. A predetermined gap is provided above the fixed electrode. One of the electrodes comprises an electrically conductive member and the other comprises a resistive member. In one embodiment, the pressing of the keytop forces the movable electrode into contact and electrical conductance with the fixed electrode. The contact creates a resistive change in the resistive member.

In one embodiment, the elastic member has a pushing portion which can push the sheet member into the substantially arc shape pushing surface of the pushing portion. When the movable electrode comes into contact with the fixed electrode, the substantially arc shape of the sheet member is elastically deformed, causing the contact between the movable electrode and the fixed electrode to change.

In a second embodiment, the input device further comprises a base upon which the sheet member can be supported. Preferably, the base is disposed below the sheet member and has a recess of a predetermined depth and/or area. Preferably, the movable electrode is positioned in a portion of the recess and the fixed electrode is positioned on a bottom surface of the recess.

In a third embodiment, the movable electrode is positioned on a first sheet member, a second sheet member is disposed on a surface opposite the movable electrode separated by a predetermined area, and the fixed electrode is positioned on a portion of the second sheet member opposite the movable electrode.

DESCRIPTION OF THE PRESENTLY PREFERRED EMBODIMENTS

Figure 1:
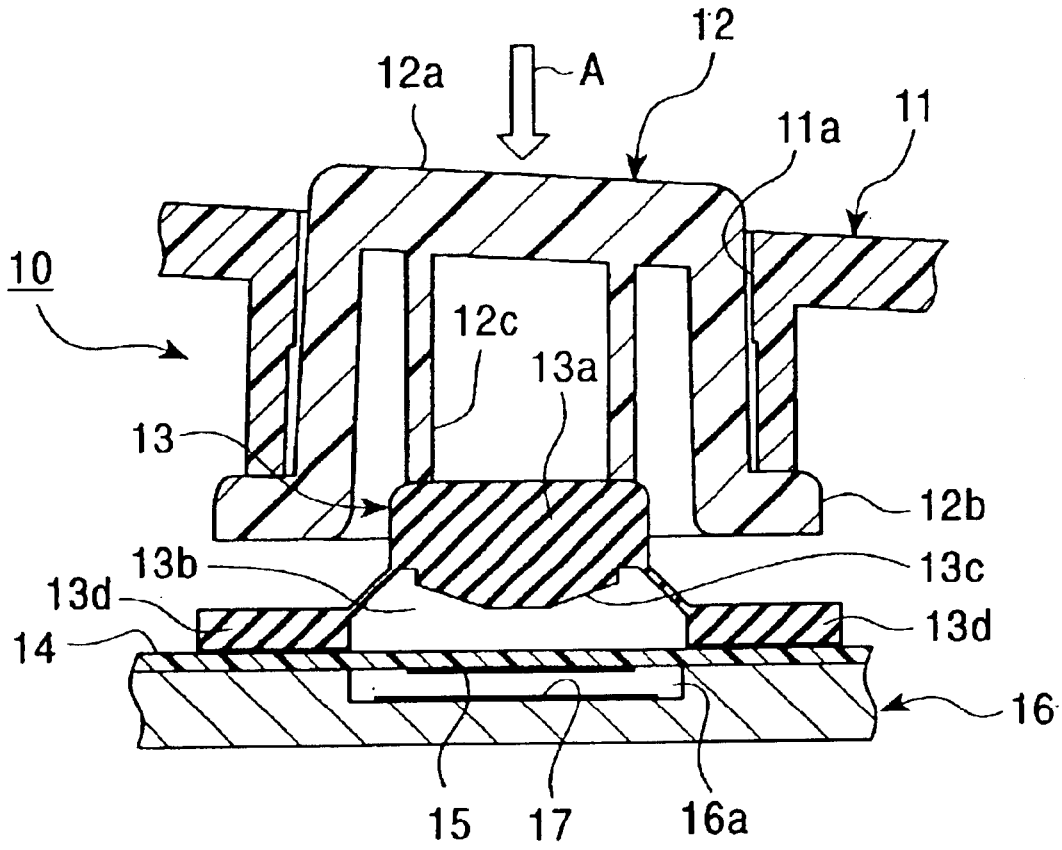
FIG. 1 is a sectional view of a main portion of a first embodiment of the present invention.

FIG. 1 is a sectional view of a main portion of a first embodiment of an input device. As shown, an input device 10 includes a keytop 12 adjacent and partially supported in a holding portion 11*a* (pipe-shaped hole) formed within a portion of a top case 11 of a housing. The housing can be part of a television or video game or any other device that utilizes variable or discrete switches.

Preferably, the keytop 12 includes a pressing portion 12*a* positioned at the top of the keytop 12. The keytop 12 further includes a cylindrical hollow cavity that is vertically movable and partially enclosed by the holding portion 11*a* of the top case 11.

A flange 12*b* is formed near a bottom portion of the keytop 12. As shown in FIG. 1, the flange acts as a stopper that is in movable contact with the holding portion 11*a*. The keytop 12 further includes plurality of protrusions 12*c* that project from a lower surface of the keytop 12 within the cylindrical cavity.

A deformable elastic member 13, preferably formed of an insulating material such as rubber, is disposed below the keytop 12 as shown in FIG. 1. The elastic member 13 preferably has a pushing portion 13*a* at or near the top portion of the protrusions 12*c*. A dome-shaped hollow area 13*b* is partially enclosed by the elastic member 13. A pushing surface 13*c*, which protrudes downward in a substantially arc shape having a substantially flat vertex, is formed at an inside surface of the pushing portion 13*a* at or near the top portion of the hollow area 13*b*.

Preferably, the elastic member 13 has mounting bars 13*d* formed at or near the outer periphery of the elastic member 13 and enclose a portion of the hollow area 13*b*. Preferably, the protrusions 12*c* are in contact with a top surface of the pushing portion 13*a* of the elastic member 13. When the input device is not actuated, the elastic member 13 biases the keytop 12 upward.

An elastically deformable film-like sheet member 14 is disposed below the elastic member 13. The elastic member 13 is preferably coupled to the sheet member 14 by an adhesive. The sheet member 14 may be formed of rubber and can be a unitary part of the elastic member 13.

A movable electrode 15, which is preferably a resistive member, is positioned on a portion of a back surface of the sheet member 14 opposite the pushing portion 13*a*. In one embodiment, a movable electrode pattern is produced by a screen printing process. Preferably, the sheet member 14 is supported by a base 16, which is, for example, a bottom case of a housing. A recess 16*a* having a predetermined depth or area is formed in a portion of the base 16 where the movable electrode 15 is enclosed. In this embodiment, the base 16 is not limited to a bottom case of a housing, so that it may be a part of many structures including a plate-shaped member disposed within a housing.

A flat or substantially flat fixed electrode 17, that can also be formed by a screen printing process using electrically conductive ink or other methods, is positioned on a bottom surface of the recess 16*a* of the base 16. A predetermined gap or area separates the movable electrode 15 from the fixed electrode 17.

In the illustrated input device 10, a switching circuit is comprised of the movable electrode 15 and the fixed electrode 17. When the movable electrode 15 comes into contact with and separates from the fixed electrode 17, the switching circuit is turned on and off.

Although, in a first embodiment the movable electrode 15 comprises a resistive member, and the fixed electrode 17 comprises an electrically conductive member, the movable electrode 15 may be an electrically conductive member, and the fixed electrode 17 may be a resistive member. In other words, one of the movable electrode 15 and the fixed electrode 17 comprises an electrically conductive member, and the other of the movable electrode 15 and the fixed electrode 17 comprises a resistive member.

Preferably, when the keytop 12 is pressed by a pressing force downward in the direction of arrow A shown in FIG. 1, the protrusions 12*c* apply a pressure against the pushing portion 13*a* and elastically stretches and urges a portion of the elastic member 13 downward. By the temporary-elastic deformation of the elastic member 13, the substantially arc-shaped pushing surface 13*c* of the pushing portion 13*a* pushes the sheet member 14, disposed below it, downward. This movement causes the sheet member 14 to be elastically deformed into an arc shape toward the recess 16*a* within the base 17. This movement further causes the movable electrode 15 to come into contact with the fixed electrode 17.

When the switch or input device 10 is closed, the sheet member 14 pushed by the pushing surface 13*c* is elastically deformed into a shape substantially similar to the arc-shaped pushing surface 13*c*. Preferably, the movable electrode 15 also deforms into a substantially arc shape, so that the substantially central portion of the movable electrode 15 comes into contact and into electrical conductance with the fixed electrode 17.

When the movable electrode 15 and the fixed electrode 17 come into contact with each other, the switching circuit between the movable electrode 15 and the fixed electrode 17 is turned on. By further exerting a pressing force to the keytop 12 after the switching circuit is turned on, the substantially arc-shaped pushing surface that the movable electrode 15 assumed is elastically changed to the shape of the flat fixed electrode 17.

Elastic deformation of the sheet member 14 and movable electrode 15 causes the contact area of the movable electrode 15 and the fixed electrode 17 to change, so that the resistance of the movable electrode 15, which in this embodiment is a resistive member, changes, thereby making it possible to adjust an analog or digital output. In an analog embodiment, the change in resistance varies the conductance between the movable electrode 15 and the fixed electrode 17. When the contact area increases the conductance increases, allowing additional current to be transferred through the switch. In some embodiments, the variable conductance path can be used to control a menu selection in a personal computer or a character movement in a television or a video game.

Figure 2:
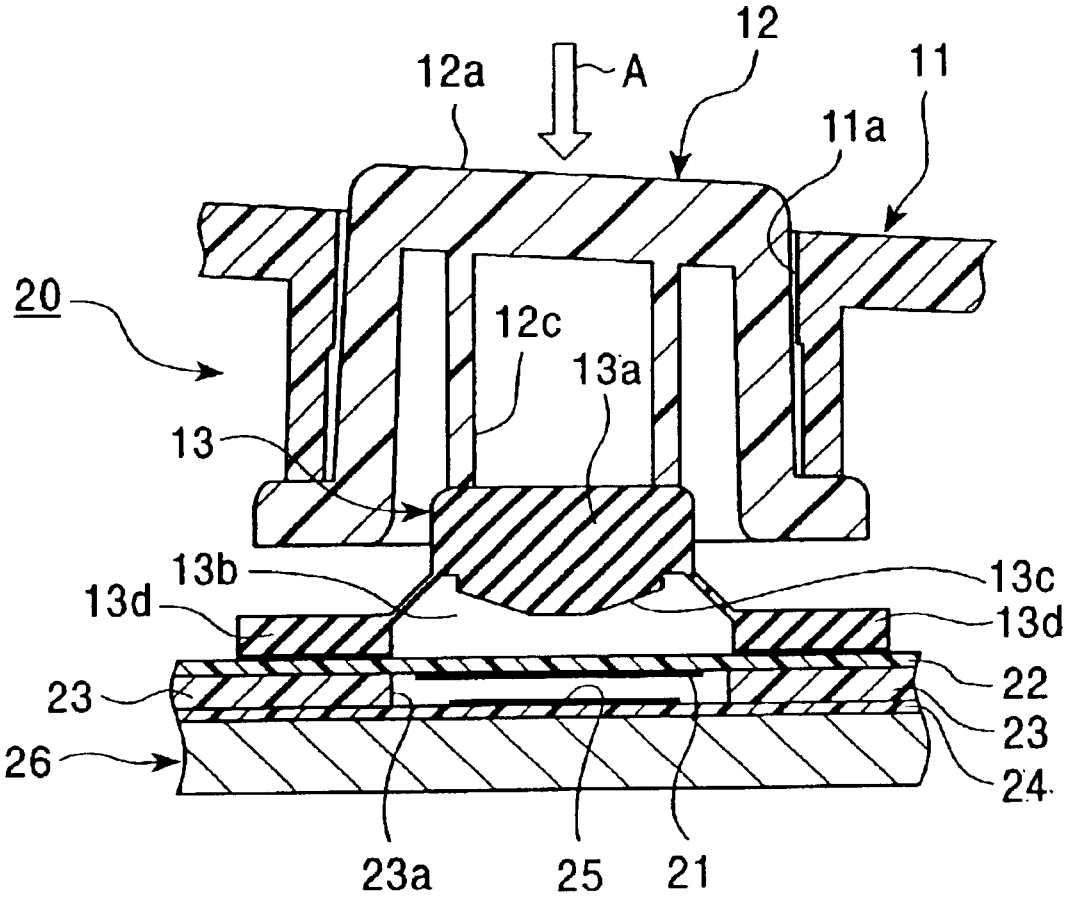
FIG. 2 is a sectional view of a main portion of a second embodiment of the present invention.
Figure 3:
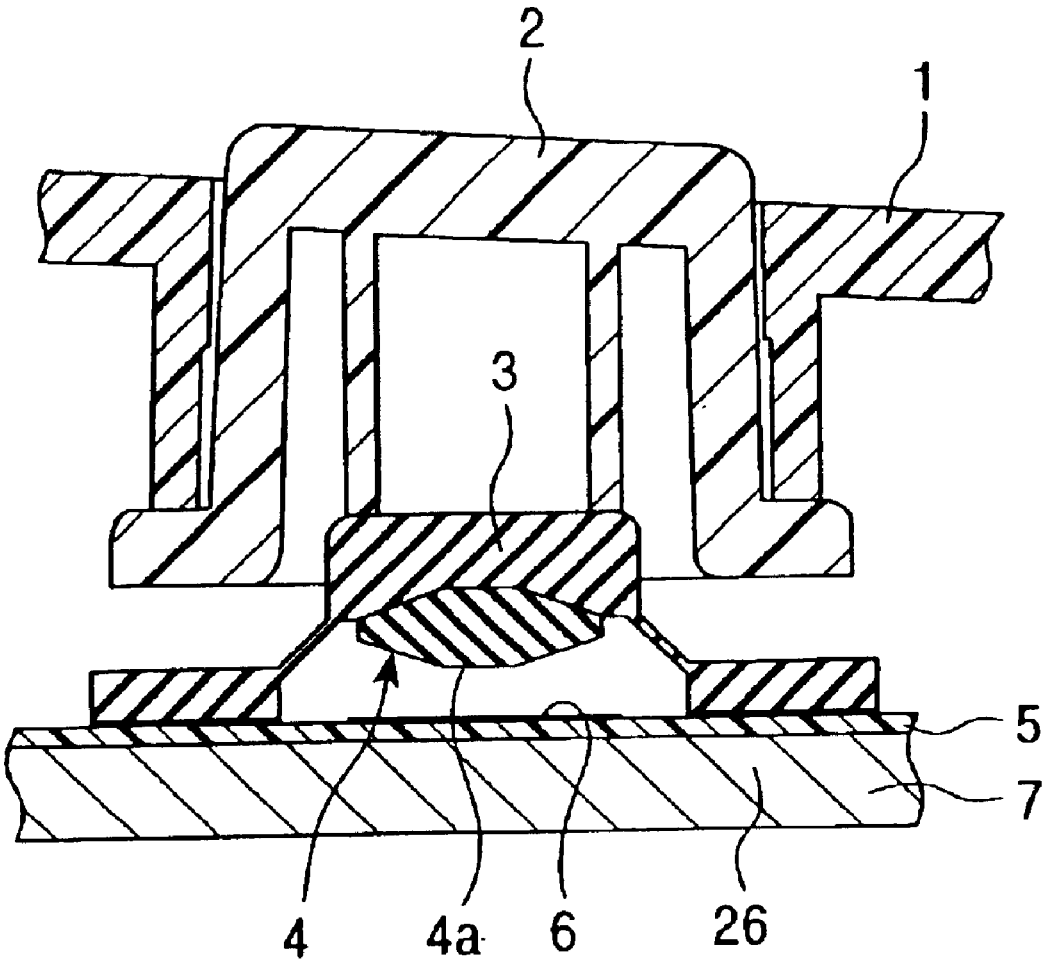
FIG. 3 PRIOR ART
FIG. 3 is a sectional view of a prior art device.

As shown in FIG. 2, an input device 20 of a second embodiment comprises a top case 11, a keytop 12, and an elastic member 13. Preferably, similar components of the first and second embodiment are designated by the same reference numbers.

In the second embodiment, a first sheet member 22 having a movable electrode 21 positioned on a back or lower surface is disposed below the elastic member 13. The movable electrode 21 comprises an electrically conductive member. Preferably, the electrically conductive member is formed by a screen printing process.

A second sheet member 24 is disposed below and opposite the first sheet member 22 upon a substantially flat, plate shaped base 26. Preferably, a spacer 23 having a predetermined depth separates the first sheet member 22 from the second sheet member 24. A fixed electrode 25, which preferably comprises a resistive member, is positioned on a portion of the second sheet member 24 opposite the movable electrode 21. Like the electrically conductive member, the resistive member can be formed by any method including a screen printing process, for example.

A hole 23*a* having an outer diameter which is larger than a diameter of the movable electrode 21 is preferably formed in a portion of the spacer 23. Preferably, the hole 23*a* and the spacer 23 act as a compressible layer that allows the movable electrode 21 to come into contact and electrical conductance with the fixed electrode 25.

When the keytop 12 is moved downward by a downward pressing force upon the keytop 12 in the direction of arrow A, preferably the elastic member 13 is elastically deformed causing the pushing surface 13*c* to come into contact with the first sheet member 22. When contact occurs, the first sheet member 22 becomes elastically deformed and stretches towards the second sheet member 24. Preferably this change in the second sheet member 24 causes the movable electrode 21 to come into contact and electrical conductance with the fixed electrode 25. This contact between the movable electrode 21 and the fixed electrode 25 turn on the switching device.

When a pressing force is further exerted upon the keytop 12 after the switching circuit is turned on, the pushing surface 13*c*, which has a substantially arc shape, becomes adapted to a flat shape that substantially conforms to the shape of the flat fixed electrode 25. Elastic deformation of the pushing portion 13*a* into a flat shape causes the area of contact between the movable electrode 21 and the fixed electrode 25 to change, so that the resistance of the fixed electrode 25 changes. In accordance with this change in the resistance, an analog and/or digital output can be achieved.

Like the first embodiment, the second embodiment can be integrated or interfaced with many devices, for example, the input device may interface a personal computer or a television or video game Such input devices 10 and 20 of the first and second embodiments can use low cost movable electrodes 15 and 21 and fixed electrodes 17 and 25 formed through a low-cost printing process. In some embodiments, screen printing allows electrode patterns to be made directly without the additional complications of photolithography and chemical etching.

As described, when the elastic member pushes the sheet member due to pressing force on the keytop, the movable electrode comes into contact with the fixed electrode, causing the resistance of a resistive member to change. In these embodiments, a switching circuit is turned on by bringing the movable electrode into electrical contact with the fixed electrode. A variable analog output can be produced due in part to the changes in the resistance of the resistive member. Accordingly, it is possible to provide an input device that can be used in many devices including games.

In the above-described embodiments changes in the pressing force exerted upon the keytop internally adjusts the level of conductance. Preferably, the change in contact varies the resistance of the resistive member of one of the electrodes. In one embodiment, a base upon which the sheet member is supported is disposed below the sheet member. Preferably, a recess of a predetermined depth or area is formed within a portion of the base and partially encloses the movable electrode. In this embodiment, the fixed electrode is formed near the bottom surface that bounds the recess where the base is part of a case of a housing.

In another input device, the movable electrode is formed on the first sheet member, the second sheet member is disposed at a side opposite the movable electrode through a space having a predetermined depth, and the fixed electrode is formed on a portion of the second sheet member opposite the movable electrode.

While various embodiments of the invention have been described, it will be apparent to those of ordinary skill in the art that many more embodiments and implementations are possible that are within the scope of this invention. Accordingly, the invention is not to be restricted except in light of the attached claims and their equivalents.

What is claimed is:

1. An input device comprising:

a keytop;

an elastic member coupled to the keytop, the elastic member being elastically deformable by pressing the keytop;

a movable electrode coupled to the elastic member;

a base positioned below the movable electrode; and a fixed electrode disposed within a recess of the base;

wherein a resistance of one of the fixed electrode or the movable electrode changes when a contact surface between the fixed electrode and the movable electrode changes due to a deformation of the elastic member caused by a corresponding force pressing on the keytop.

2. The input device of claim 1 wherein the resistance of one of the fixed electrode or the movable electrode changes in response to a movement of the movable electrode.

3. The input device of claim 2 wherein the resistance of the fixed electrode changes in response to the movement of the movable electrode.

4. The input device of claim 1 wherein the movable electrode is disposed within the recess of the base and is configured by a screen printing.

5. The input device of claim 1 further comprising a sheet member disposed above the movable electrode and the fixed electrode.

6. The input device of claim 5 wherein the sheet member is disposed over the recess and the base.

7. The input device of claim 1 wherein the elastic member comprises an arc shape pushing surface positioned above the movable electrode and the fixed electrode.

8. The input device of claim 7 further including a mounting bar enclosing a hollow portion positioned above the movable electrode and below the arc shaped pushing surface.

9. The input device of claim 8 wherein the arc shape pushing surface is elastically deformable and the resistance of one of the fixed electrode or the movable electrode changes in response to a degree that the arc shape deforms when the movable electrode is in contact with the fixed electrode.

10. An input device comprising:

a keytop;

an elastic member which can be elastically deformed by pressing the keytop; and a movable electrode and a fixed electrode which can come into electrical conductance with each other by coming into contact with each other by an elastic deformation of the elastic member, the movable electrode being positioned on a sheet member disposed above the fixed electrode with a predetermined gap provided above the fixed electrode, one of the movable electrode and the fixed electrode being an electrically conductive member and the other of the movable electrode and the fixed electrode being a resistive member;

wherein, by causing the elastic member to push the sheet member, the movable electrode comes into contact and electrical conductance with the fixed electrode, and an electrical resistance of the resistive member changes correspondingly to the elastic deformation of the elastic member.

11. The input device according to claim 10, wherein the elastic member has a pushing portion configured to push the sheet member, the pushing portion protruding in a substantially arc shape, and wherein, when the movable electrode comes into contact with the fixed electrode, the substantially arc shaped pushing portion is elastically deformed, so that an area of contact of the movable electrode with the fixed electrode changes.

12. The input device according to claim 11, further comprising a base upon which the sheet member is supported, the base being disposed below the sheet member and having a recess formed in a portion thereof where the movable electrode is positioned, the recess being bound by the fixed electrode.

13. The input device according to claim 10, wherein the movable electrode is coupled to a first sheet member, and wherein a second sheet member is disposed at a side opposite the movable electrode through a spacer having a predetermined thickness, and wherein the fixed electrode is supported on a portion of the second sheet member opposite the movable electrode.

* * * * *